US006518851B2

(12) United States Patent
Kocharyan

(10) Patent No.: US 6,518,851 B2
(45) Date of Patent: Feb. 11, 2003

(54) CONFINED-FLUX FERRITE STRUCTURE FOR CIRCULATOR/ISOLATOR

(75) Inventor: Karen Kocharyan, Somerville, MA (US)

(73) Assignee: Renaissance Electronics Corporation, Harvard, MA (US)

( * ) Notice: Subject to any disclaimer, the term of this patent is extended or adjusted under 35 U.S.C. 154(b) by 45 days.

(21) Appl. No.: 09/827,787

(22) Filed: Apr. 9, 2001

(65) Prior Publication Data

US 2002/0039054 A1 Apr. 4, 2002

Related U.S. Application Data

(60) Provisional application No. 60/203,865, filed on May 12, 2000.

(51) Int. Cl.[7] ..... H01P 1/38
(52) U.S. Cl. ..... 333/1.1; 333/24.2
(58) Field of Search ..... 333/1.1, 24.2; H01P 1/39, 1/387

(56) References Cited

U.S. PATENT DOCUMENTS 4,122,418 A * 10/1978 Nagao ..... 333/1.1 X
4,390,853 A * 6/1983 Mathew et al. ..... 333/1.1
6,348,843 B1 * 2/2002 Furuya et al. ..... 333/1.1

* cited by examiner

*Primary Examiner*—Justin P. Bettendorf

(57) ABSTRACT

A ferrite structure for non-reciprocal microwave device such as circulator/isolator. The structure includes one or more composite ferrite bodies, each having at least one region of a soft ferrite material and at least one region of a hard ferrite material, and at least two ferrous/ferrite plates. The ferrous/ferrite plates are attached to the composite ferrites so as to contribute to the completion of the magnetic loop via hard and soft ferrite portions of the composite ferrites. The soft and hard ferrite regions are magnetized in the opposite directions. The range of operation is selected to be between the resonant frequencies of soft and hard ferrite materials. With such setting the hard and soft ferrite regions provide the circulation in the same direction. As compared to the state-of-the art devices, the circulators/isolators made according to the present invention incorporate the confined-flux self-magnetized ferrite structure thus eliminating the use of conventional magnets. These devices have extended bandwidth, are reliable in operation and inexpensive in production. The structure according to the present invention is very compact, lightweight and broadband.

7 Claims, 3 Drawing Sheets

CONFINED-FLUX FERRITE STRUCTURE FOR CIRCULATOR/ISOLATOR

CROSS-REFERENCE TO RELATED APPLICATIONS

This application claims the benefit of provisional application No. 60/203,865 filed May 12, 2000.

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

The present invention relates generally to the microwave ferrite devices and, more specifically, to the ferrite structures used in those devices which realize non-reciprocal circulation action. Most common ferrite devices are the Y-type circulators. In stripline embodiment, the Y-circulator consists of a conductive central junction situated between a pair of planar ferrite elements. Ferrites are biased externally with the DC magnetic field applied normally to their plane. Two non-ferrous metallic plates attached to the opposite faces of ferrite-junction-ferrite structure provide the electrical ground. The junction is formed of three branches extending by 120 degrees apart from the common central area. In the circulators all three branches are electrically connected to the transmission lines. In the isolators a matched load (usually a 50 Ohm resistor) terminates one of the ports.

Presently, the stripline circulators have two basic setups for the magnetic field application. The first one is a tower-like setup, where the magnets are attached to both sides of the ferrite-junction-ferrite structure. Along with two non-ferrous ground planes this setup includes also a u-shape ferrous shunt clip completing the magnetic loop, and the side cover closing the entire structure. The second setup is a drum-like design, where the magnets (usually three) composing a common plane with ferrite structure are evenly spaced along the structure's periphery. This setup includes also two ferrous plates (pole pieces) attached to the opposite faces of ferrite-magnets structure. The ferrous plates are required to direct the magnetic flux outgoing from the magnets into the ferrites situated in the central area. The heights of the magnets and ferrite-junction-ferrite stack ideally should be the same to provide a simultaneous contact with both pole pieces.

The existing circulators/isolators incorporate either the soft or hard ferrites, both exhibiting gyrotropic properties in a magnetized state. In order to maintain a magnetized state the soft ferrites should be permanently biased with an external DC magnetic field. The frequency of natural magnetic resonance (resonance at zero external magnetic field) in the soft ferrites equals almost zero. With the available external fields the frequency of magnetic resonance in the soft ferrites can be tuned only to about 20 GHz. Because of that, this class of ferrites is regarded as the low-frequency materials. The high-frequency devices usually incorporate the hard ferrites. Ferrite materials, such as Sr/Ba hexaferrite ceramic, used in those devices, typically exhibit the natural magnetic resonance at the frequencies 40 GHz and above. The hard ferrites are the permanent magnets possessing a considerable residual magnetization. Therefore, once being magnetized they are capable of maintaining the magnetization even without the external magnetic field. In the microwave range the hard ferrites are usually used as self-biased high frequency ferrites.

Typically, the stripline circulators are the narrow-band devices. The bandwidth here is defined as being a difference between the highest and lowest operation frequencies, at which an acceptable insertion loss and required isolation between the corresponding ports are maintained. If the application requires a broadband operation, the circulators should incorporate the wideband matching transformers or composite ferrites (see, for example, U.S. Pat. No. 4,205,281). The composite ferrite is made in such a way that its constituent elements (ferrite puck and rings) are. combined in a radial direction one inside the other, to have the last one encircling the. entire internal portion. The utilization of composite. ferrites in the conventional circulators allows improving the bandwidth performance by providing the circulation at two or more frequencies. This is achieved by selecting the size and magnetization of the external ferrite ring determined as a function of the lowest frequency of the pass band. The second ferrite is selected to have the dimensions and magnetization determined as a function of the second frequency being above the first frequency. The third and additional ferrite elements may be selected using the same approach (see, for example, U.S. Pat. No. 4,496,915). Since a common external magnetizing system is used in this setup, all portions of a composite ferrite are magnetized in the same direction.

In practice, it is difficult to develop a compact and lightweight circulator/isolator operating in a wide frequency range. The application of stronger magnetic fields, the utilization of sophisticated multi-ring ferrite assemblies and complicated matching transformers in order to extend the bandwidth and to increase the operational frequency, requires more space, adds to size, weight and cost. The circulators/isolators are widely used in communication equipment including those used on board of the satellite vehicles, in mobile and hand-held terminals. Therefore, increasing the operational frequency and extending the bandwidth while maintaining a small size and weight, are important goals for the design of circulators/isolators.

BRIEF SUMMARY OF THE INVENTION

For clarity, the present invention will be described in a stripline embodiment only. This, however, does not restrict in any way the scope of present invention, because it can also be implemented with other types of propagation lines, including the microstrip lines, waveguides and quasi-optical beams.

The stripline Y-circulator according to the present invention is comprised of two composite ferrites, central junction, and of at least two ferrous plates. Each composite ferrite represents a monolithic disk-shape body and consists of at least two regions. One of the regions is made from a soft ferrite and another one from a hard ferrite. Both soft and hard ferrite regions have substantially different resonant frequencies. The central junction having basically the Y-shape is situated between the composite ferrites. The ferrous plates are disposed on the external faces of a ferrite-junction-ferrite structure. The hard and soft ferrite regions of the composite ferrites are the parts of a magnetic loop completed via ferrous plates. The direction of magnetization in all hard ferrite regions is the same. The hard and soft ferrite regions are magnetized in the opposite directions. The shape of the central junction is selected to match its impedance to that of the transmission line, thereby minimizing the insertion and reflection losses. The operational bandwidth of a device incorporating this ferrite structure is selected to be between the frequencies of magnetic resonance in the soft and hard ferrites.

Thus, the new ferrite structure according to the present invention is a part of a passive microwave device such as circulator/isolator, where the RF circulation processes are developed. The composite ferrites and ferrous plates in the structure are disposed symmetrically on each side of the junction in parallel relationship with each other. The composite ferrites, each consisting of at least two ferrite portions, the soft and hard ones, have different frequencies of magnetic resonance. Both portions of a ferrite structure exhibit the gyromagnetic properties, while the hard ferrite portion possesses also the permanent magnetic properties. The magnetic flux outgoing from the hard ferrites is trapped within a magnetic loop composed by the ferrous plates and soft ferrites. As a result, the magnetization of the soft ferrites is opposite to the magnetization in the hard ferrites. The operational bandwidth is selected to be between the frequencies of magnetic resonance in the soft and hard ferrite regions.

It is a primary object of the present invention to have a compact and lightweight structure that provides a broadband circulation action, including the frequency domain that is difficult to achieve with the conventional structures (approximately from 20 to 40 GHz).

It is a further object of the present invention to have a structure wherein the areas of magnetic flux creation and confinement would be the region where. the RF circulation process takes place, by this eliminating an extra space for the external magnets.

It is the advantage of the present invention to have a ferrite structure for devices such as circulators/isolators that is easy to produce with the existing technologies, is labor saving and cost efficient.

DETAILED DESCRIPTION OF THE INVENTION

Figure 1:
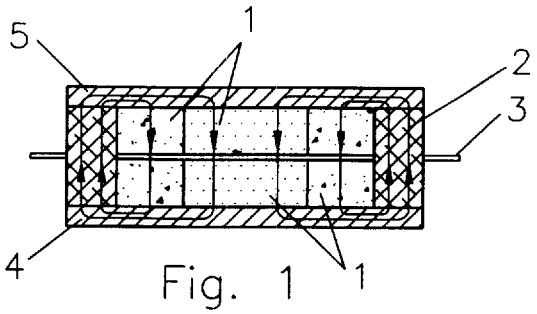
Fig. 1 Prior Art
FIG. 1 is the section view of a drum-type Y-circulator of the prior art. The arrows show that the puck and ring areas of the composite ferrite are magnetized in the same direction.
Figure 2:
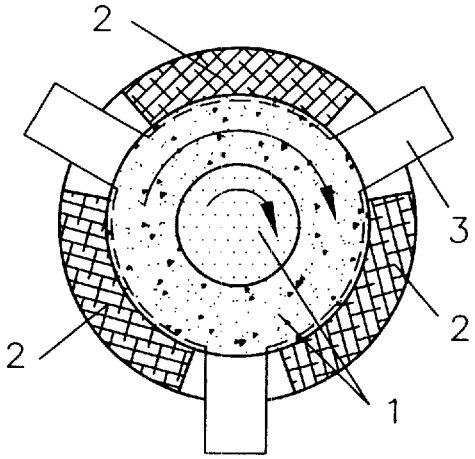
Fig. 2 Prior Art
FIG. 2 is the top view of a drum-type Y-circulator of the prior art with the top ferrous plate removed. Figure shows that the area where the magnetic flux was generated is beyond the area of RF field circulation.

The description of the present invention is given in comparison with the state-of-the-art drum-like setup ferrite structure. Referring to FIG. 1 and FIG. 2 the existing ferrite structure comprises two ferrite discs 1, a junction 3, and two ferrous plates 4, 5. Each of the ferrites 1 is made either of only one ferrite material or represents a composite body consisting of several regions of different ferrite materials (composite ferrites consisting of two regions are shown, each region having different hatch pattern). In a drum-like design of the prior art the magnetic field is usually created by three external magnets 2 disposed along the structure's periphery. These magnets are outside of the area where the field circulation is realized. The ferrous plates 4, 5 extend beyond the composite ferrites to cover also the magnets 2 in order to complete the magnetic loop. FIG. 1 shows that only a part of this loop is within the area of circulation. With such magnetic arrangement the magnetic flux has the same direction in all areas of a composite ferrite. The resulting sense of circulation also should be the same (as shown by arrows in FIG. 2) meaning that the constituent elements of a composite ferrite are made from the similar ferrite materials, either the soft or hard ones.

Before the ferrite structure according to the present invention will be described, it is expedient to consider briefly the theory of circulation. The non-reciprocal circulation in ferrite devices, such as circulators/isolators, is developed because of the gyromagnetic properties of ferrite materials. This gyrotropy is described by Polder's tensor of dynamic magnetic permeability:

$$\{\mu\} = \begin{vmatrix} \mu & iK & 0 \\ -iK & \mu & 0 \\ 0 & 0 & 1 \end{vmatrix} \tag{1}$$

Where:

$$\mu=[f_{res}(f_{res}+f_M)-f^2]/(f^2_{res}-f^2) \tag{2}$$

$$K=f_M f/(f^2_{res}-f^2) \tag{3}$$

$$f_{res}=\gamma(H_A+H_0)/2\pi \tag{4}$$

Here $H_0$ i s the external magnetic field, $H_A$ is the effective field of magnetic anisotropy, f is the operation frequency, $f_{res}$ is the frequency of magnetic resonance, $f_M=2\gamma M$ and M is the saturation magnetization.

According to (4), the frequency of natural magnetic resonance (resonance at zero external field) depends on the strength of the effective field of magnetic anisotropy. The anisotropy of soft ferrites is very small leading to the natural magnetic resonance at very low frequencies. The hard ferrites are highly anisotropic materials. Correspondingly, they displaying the natural magnetic resonance at the frequencies about 40 GHz and above.

As follows from (1), the circular components of a magnetic permeability are given as:

$$\mu_{\pm}=(f_{res}f_M\pm f)/(f_{res}\pm f) \quad (5)$$

These components correspond to the waves propagating in the clockwise and counter-clockwise directions, respectively. The interference of counter-propagating waves within ferrite elements, such as discs or rings used in circulators/isolators, creates the standing waves known also as the resonant modes.

The azimuth of a resonant mode with respect to the input port is proportional to the anisotropic splitting factor $K/\mu$:

$$K/\mu=f_M f/[f_{res}(f_{res}+f_M)-f^2] \quad (6)$$

Figure 5:
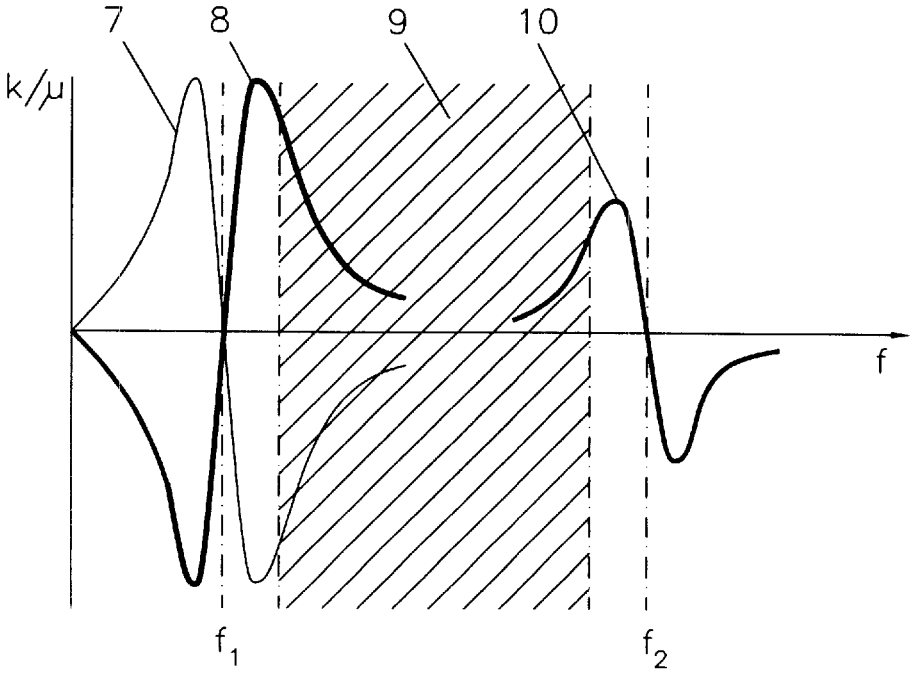
FIG. 5 illustrates the mutual relationship between the anisotropic splitting factors of the soft and hard ferrite regions. The bold lines correspond to the magnetic configuration realized in a confined-flux ferrite structure according to the present invention. The dashed area is the operation range for circulator incorporating confined-flux ferrite structure according to the present invention.

According to (6), the splitting factor increases as the operational frequency approaches the resonance and changes the sign as the frequency passes through the resonance (see, for example, the line 7 on FIG. 5). Changing the direction of magnetization inverts the graph for anisotropic splitting factor (see the line 8 on FIG. 5). In a demagnetized state the anisotropic splitting factor is equal to zero. Correspondingly, there is no azimuthal rotation of the excited resonant modes. The application of external magnetic field in direction normal to the plane of ferrite element increases the splitting factor and introduces azimuthal rotation of the modes. This rotation is used in the Y-type circulators/isolators to couple the input port with one of the output ports and to isolate it from another one.

Figure 3:
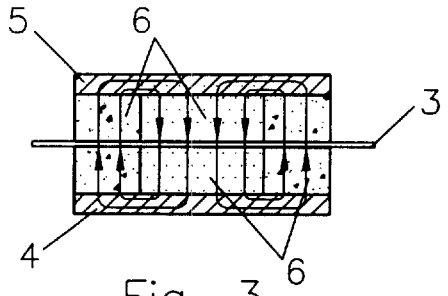
FIG. 3 is the section view of a preferred embodiment of the confined-flux ferrite structure according to the present invention, showing that the magnetic loop occupies the entire circulation area. The arrows show that the soft and hard ferrite portions being parts of the magnetic loop are magnetized in the opposite directions.
Figure 4:
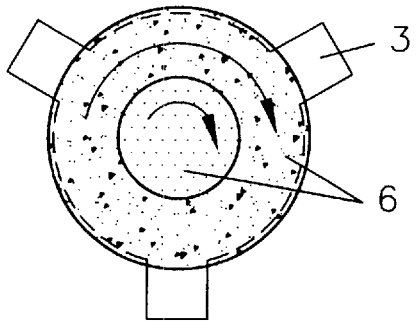
FIG. 4 shows the top view of the confined-flux ferrite structure according to the present invention with the top ferrous plate removed. Arrows show that the soft and hard ferrite portions of the confined-flux ferrite structure have the same sense of circulation.

Referring to FIG. 3 and FIG. 4, the confined-flux ferrite structure according to the present invention comprises two ferrite discs 6, a junction 3, and two ferrous plates 4, 5. Each of the ferrite discs 6 represents a composite body consisting of two portions: the central puck and external ring (both shown with different hatch patterns). One of those portions is made from a soft ferrite. and another one from a hard ferrite. Both ferrite portions, a puck and the ring, are disposed concentrically, forming, as shown in FIG. 4, a round disk-like structure 6. Which material (soft or hard) is disposed within a disk-like structure as the puck, and which one is disposed as the ring, depends on a particular design and may be chosen by a designer.

The junction 3 is disposed between the composite ferrites 6. The ferrous plates 4 and 5 are attached to the outside faces of the composite ferrites 6. The junction 3, having Y-like shape, includes the central area, which is disposed substantially within the perimeter of composite ferrites 6. It has three branches projecting outwardly from the central area by 120 degrees apart.

In operation, the permanent magnetic properties of the hard ferrites allow to create the magnetic flux. The generated flux is directed toward the soft ferrites via the ferrous plates 4 and 5, thus completing a magnetic loop, as shown in FIG. 3. This loop is spread throughout the entire circulation area with the soft and hard ferrites having opposite directions of magnetization.

Referring to (6), the sense of circulation depends on the direction of magnetization and the sign of frequency offset ($f_{res}-f$). In confined-flux ferrite structure the hard and soft ferrites are always magnetized in the opposite directions. One may conclude that this would lead to opposite senses of circulation in these areas, resulting in cancellation of overall circulation effect. However, in this consideration the effect of frequency offset should also be accounted. If the operational frequency is set between the frequencies of magnetic resonance in soft and hard ferrite materials, we will get the opposite signs for the frequency offsets in these two regions, positive for the hard ferrite, and negative for the soft ferrite. The combined effects of both factors (direction of magnetization and frequency offset) will lead to the same sense of circulation in all areas of the confined-flux ferrites structure, as is shown by arrows in FIG. 4. Since the frequency offset between the resonance in hard and soft materials is considerable, one will get a wide frequency range where a constructive circulation is maintained. Correspondingly, a circulator incorporating the confined-flux ferrite structure according to the present invention will demonstrate very broadband frequency performance.

The operation of a device according to the present invention is illustrated by the graph in FIG. 5. The vertical lines f1 and f2 show the positions of magnetic resonance in soft and hard ferrite materials, respectively. The hatched area 9 represents the frequency range of operation of the circulator according to the present invention. The curves 7 and 10 show the dispersion of an anisotropic splitting factor in the soft and hard ferrites when both ferrites are magnetized in the same direction. With an arrangement in FIGS. 3, 4, showing the negative. sign for magnetization in the soft ferrite, the curve 7 should be inverted into the mirror image (curve 8). As the line is inverted, both curves (8 and 10) in the hatched area appear in the same circulation domain (positive, as shown in FIG. 5). In theory, the range of operation extends from the resonance in soft ferrite material throughout the resonance in hard ferrite material. In practice, however, this range should be narrowed from both sides to avoid an excessive loss associated with the magnetic resonance.

For the magnetic activation the confined-flux ferrite structure should be temporary exposed to the external magnetic field. This will permanently magnetize the hard ferrite, and the generated magnetic flux will be trapped within a magnetic loop completed via ferrous plates and soft ferrites. To minimize the microwave losses the ferrite materials should be maintained close to the magnetic saturation. In a confined-flux ferrite structure this is achieved by selecting the dimensions and magnetic parameters of ferrite portions according to the following relationship:

$$M_{hard}\times S_{hard}\geqq M_{soft}\times S_{soft} \quad (7)$$

where M and S are, respectively, the saturation magnetization and the cross section area of a ferrite material. Since the demagnetizing factor in a closed loop is very small, the structure will maintain the state of saturation even without the external magnetic field.

Figure 6:
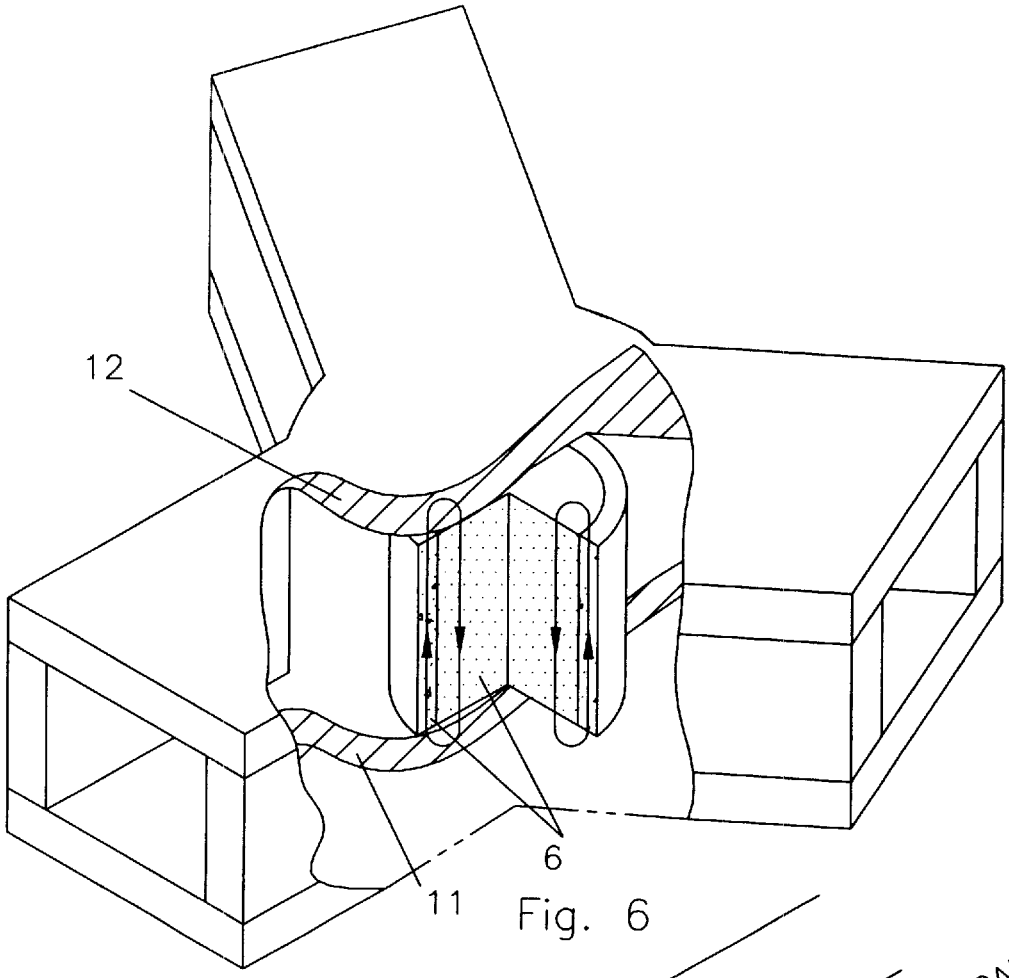
FIG. 6 shows the embodiment of the confined-flux ferrite structure according to the present invention in a waveguide Y-circulator. The upper and lower waveguide walls made from ferrous metal are touching the top and bottom faces of a composite ferrite situated in the center of a waveguide junction.

The embodiment of the confined-flux ferrite structure in a waveguide circulator is also within the scope of the present invention. FIG. 6 shows a waveguide circulator incorporating the confined-flux ferrite structure according to the present invention. It consists of a waveguide Y-junction with the top and bottom walls 11, 12 made from a ferrous metal. It also includes a composite ferrite post 6 having the same magnetic structure as the composite ferrite 6 shown in FIG. 3 and FIG. 4. The post 6 is disposed in the center of a waveguide junction and ideally has the same height as the internal height of a waveguide. The upper and lower ferrous walls 11, 12 are acting similarly to the ferrous plates 5 and 4 in FIG. 3, thus trapping the flux inside the ferrite 6. The ferrite post 6 in this embodiment may have a shape of an elongated cylinder, but it operates in the same manner as was described above for a stripline circulator/isolator. The difference with the strip-line set-up is that the waveguide option incorporates only one composite ferrite and it does not have the central junction 3.

Figure 7:
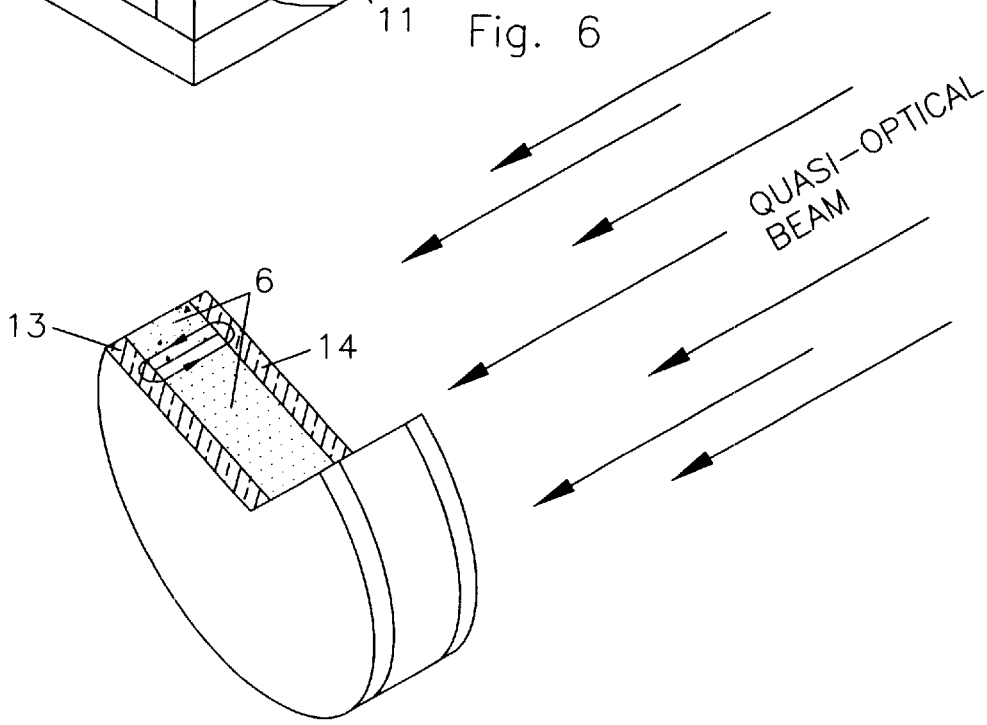
FIG. 7 shows the implementation of the confined-flux ferrite structure according to the present invention in a quasi-optical Faraday circulator. The central disc is a composite ferrite consisting of the soft and hard ferrite regions. Two ferrite plates are attached to the faces of a composite ferrite to close the magnetic loop. The entire structure is transparent to the incident quasi-optical beam.

FIG. 7 shows a quasi-optical Faraday circulator incorporating the confined-flux ferrite structure according to the present invention. Such circulator is also within the scope of the present invention. It includes a composite ferrite disc 6 and two ferrite plates 13, 14. The ferrite plates 13, 14 attached to the faces of ferrite disc 6 provide a magnetic path completing the magnetic loop via soft ferrite portions of the composite ferrite 6, as shown in FIG. 7. The whole structure is transparent to the incident quasi-optical beam, which frequency is set between the frequencies of magnetic resonance in soft and hard ferrites. The quasi-optical beam illuminates the entire aperture of a composite ferrite, including the soft and hard ferrite portions. This linearly polarized beam undergoes the rotation of polarization (Faraday-effect) as it passes through a confined-flux ferrite structure. Despite the opposite directions of magnetization in soft and hard ferrite regions, the sense of rotation of polarization in both these regions remains the same (for the reason explained above).

Figure 8:
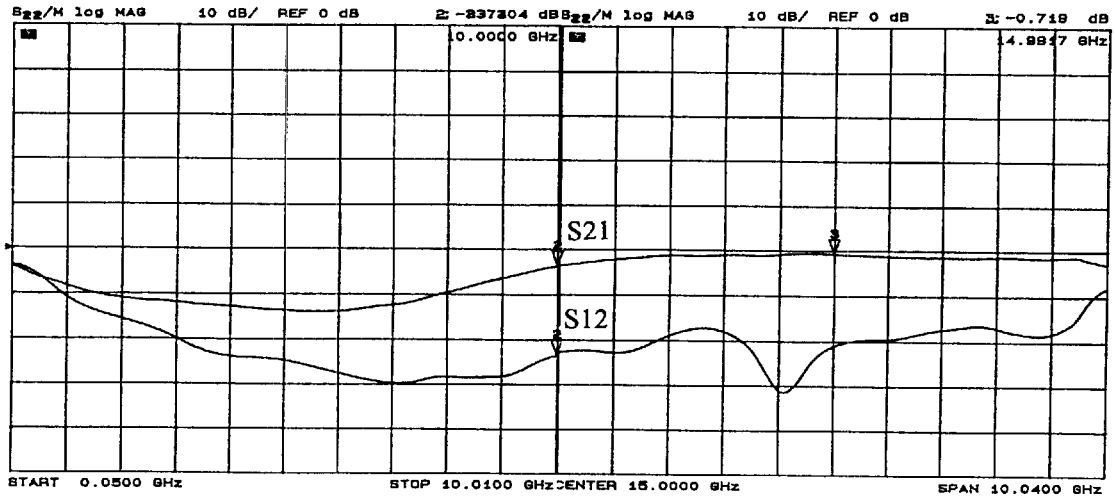
FIG. 8 is an experimental graph illustrating a broadband performance of the prototype stripline compact circulator incorporating the confined-flux ferrite structure according to the present invention. The prototype circulator has the overall dimensions of 0.5"×0.5"×0.15".

FIG. 8 shows the experimental data (scattering parameters versus frequency) for a compact circulator (0.5"×0.5"×0.15") incorporating the confined-flux ferrite structure according to the present invention. Despite the small sizes, this circulator has very broad operational bandwidth spanning from 12 to 18 GHz (insertion loss<1 dB, isolation>17 dB and VSWR<−15 dB). Moreover, one can see that the actual circulation (the splitting between $S_{12}$ an $S_{21}$) extends further toward the lower and higher frequencies, indicating the potential for further bandwidth extension.

Thus, the ferrite structure according to the present invention has the ability of generating and maintaining within itself a magnetic flux. In a magnetized state the confined-flux ferrite structure exhibits broadband gyromagnetic properties. Accordingly, the circulator incorporating such ferrite structures does not require the external magnets and demonstrates wider operational bandwidth than the conventional devices. The elimination of the external magnets and their supporting elements allows reducing the number of parts. This makes such devices more compact, lightweight and reliable in operation. Correspondingly, the devices incorporating confined-flux ferrite structure are less labor consuming and less expensive in production.

While the stripline embodiment of the invention has been described in details above, it is clear that there are variations and modifications to this disclosure here and above which will be readily apparent to one of the ordinary skills in the art. For example, the composite ferrite may have triangular or other symmetrical shape. The hard-soft ferrite combination, as described above and shown in FIGS. 3, 4 can also be implemented in other non-reciprocal devices, such as having more than three ports. To the extent that such variations and modifications of the present disclosure of ferrite structure for circulator/isolator, wherein: a) the soft ferrite element is disposed with respect to the hard ferrite so as to contribute to the completion of magnetic loop, b) the soft and hard ferrite regions have opposite directions of magnetization, and c) the operation frequency is selected to be between the resonance frequencies of soft and hard ferrite materials, such are deemed within the scope of the present invention.

Having described my invention, I claim:

1. A confined-flux ferrite structure for circulator/isolator comprising a first composite body of a gyromagnetic material;

a second composite body of a gyromagnetic material;

at least two plates of ferromagnetic material;

a junction of electrically conductive material, wherein said composite bodies having at least one region of soft ferrite material with a first resonant frequency and one region of hard ferrite material with a second resonant frequency, said hard ferrite material region is magnetized and disposed relative to the said soft ferrite material region so as to complete the magnetic loop in said structure, and operation bandwidth of said circulator/isolator is selected to be between said first and said second resonant frequencies and said junction is disposed between and against said first and said second composite bodies, said plates are disposed each outside and against said composite bodies.

2. A structure as recited in claim 1, wherein said first and said second composite bodies each having disk-like shape with one of said ferrite material regions is disposed centrally as a puck, and at least another one of said ferrite material regions is disposed as a ring concentrically around said puck.

3. A structure as recited in claim 1, wherein said first composite body of gyromagnetic material and said second composite body of gyromagnetic material and also said two plates of ferromagnetic material are symmetrically disposed about said junction in parallel relationship to and in contact with each other.

4. A structure as recited in claim 1, wherein said junction of electrically conductive material having Y-like shape with central portion and three branches, said central portion disposed concentrically to and basically within said composite body area, and said three branches outgoing 120 degrees apart from said central portion.

5. A structure as recited in claim 1, wherein said soft ferrite material region and said hard ferrite material region having opposite directions of magnetization.

6. A confined-flux ferrite structure for circulator/isolator, comprising at least one composite body of a gyromagnetic material;

at least two plates of a ferromagnetic material, wherein said composite body having at least one region of soft ferrite material with a first resonant frequency and at least one region of hard ferrite material with a second resonant frequency, said regions disposed concentrically in the same plane and in between said plates of ferromagnetic material, said hard ferrite material region is magnetized and disposed relative to said soft ferrite material region so as to complete the magnetic loop, said regions having opposite direction of magnetization, operation frequency is adapted to be between said first and said second resonant frequencies, and said structure is adapted to be used in devices with waveguide transmission lines.

7. A confined-flux ferrite structure for circulator/isolator, comprising at least one composite body of a gyromagnetic material;

at least two plates of a ferrimagnetic material, wherein said composite body having at least one region of soft ferrite material with a first resonant frequency and at least one region of hard ferrite material with a second resonant frequency, both said regions disposed in the same plane and in between said plates of ferrimagnetic material, said hard ferrite material region is magnetized and disposed relative to said soft ferrite material region so as to complete the magnetic loop, said regions having opposite direction of magnetization, operation frequency is adapted to be between said first and said second resonant frequencies, and said structure is adapted to be used in devices having quasi-optical transmission lines.

* * * * *